US007449652B2

(12) United States Patent
Rakus et al.

(10) Patent No.: US 7,449,652 B2
(45) Date of Patent: Nov. 11, 2008

(54) CATCHMENT MECHANISM TO PREVENT CAMSHAFT OVER-ROTATION DURING CLOSURE IN A DIRECT-DRIVE STORED ENERGY MECHANISM

(75) Inventors: Paul R. Rakus, Beaver Falls, PA (US); Perry R. Gibson, East Palestine, OH (US); Andrew L. Gottschalk, Pittsburgh, PA (US); Douglas C. Marks, Murrysville, PA (US); Robert M. Slepian, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/758,756

(22) Filed: Jun. 6, 2007

(65) Prior Publication Data

US 2008/0237015 A1 Oct. 2, 2008

Related U.S. Application Data

(63) Continuation-in-part of application No. 11/693,198, filed on Mar. 29, 2007.

(51) Int. Cl.
*H01H 9/00* (2006.01)

(52) U.S. Cl. ..... 200/400

(58) Field of Classification Search ..... 200/400, 200/401, 500, 501, 318, 323–325, 327
See application file for complete search history.

(56) References Cited

U.S. PATENT DOCUMENTS

| | | | | |
|---|---|---|---|---|
| 6,437,269 | B1 * | 8/2002 | Rakus | 200/400 |
| 6,515,245 | B2 * | 2/2003 | Marin-Pache et al. | 200/400 |
| 6,610,949 | B2 * | 8/2003 | Mori et al. | 200/400 |
| 7,038,155 | B2 * | 5/2006 | Ahlert et al. | 200/400 |
| 7,115,830 | B1 * | 10/2006 | Weister et al. | 200/400 |
| 7,294,804 | B1 * | 11/2007 | Gottschalk et al. | 200/400 |

* cited by examiner

*Primary Examiner*—Michael A Friedhofer
(74) *Attorney, Agent, or Firm*—Martin J. Moran

(57) ABSTRACT

A catchment mechanism for an electrical switching apparatus operating mechanism is provided. The catchment mechanism includes a catchment wheel with a radially extending surface, a catchment prop, and a catchment prop reset pin. The catchment wheel rotates with the cam in the closing assembly as the closing springs are being charged. During the charging of the springs, the catchment prop stop edge travels over, but preferably does not engage, the wheel outer surface. When the closing springs are released, the catchment prop stop edge engages the catchment wheel radially extending surface thus causing the catchment wheel to stop rotating. As the catchment wheel is fixed to the cam shaft, the rotation of the cam shaft, and therefore the cam, is also stopped. The catchment wheel radially extending surface is positioned so that the cam is stopped in an appropriate position to begin recharging the closing spring.

20 Claims, 10 Drawing Sheets

CATCHMENT MECHANISM TO PREVENT CAMSHAFT OVER-ROTATION DURING CLOSURE IN A DIRECT-DRIVE STORED ENERGY MECHANISM

CROSS REFERENCE TO RELATED APPLICATION

This application is continuation-in-part of application Ser. No. 11/693,198, filed Mar. 29, 2007, entitled "SPRING DRIVEN RAM FOR CLOSING AN ELECTRICAL SWITCHING APPARATUS".

BACKGROUND OF THE INVENTION

1. Field of the Invention

The present invention relates to an electrical switching apparatus operating mechanism and, more specifically to a catchment mechanism structured to prevent over rotation of a closing assembly cam.

2. Background Information

Electrical switching apparatus, typically, include a housing, at least one bus assembly having a pair of contacts, a trip device, and an operating mechanism. The housing assembly is structured to insulate and enclose the other components. The at least one pair of contacts include a fixed contact and a movable contact and typically include multiple pairs of fixed and movable contacts. Each contact is coupled to, and in electrical communication with, a conductive bus that is further coupled to, and in electrical communication with, a line or a load. A trip device is structured to detect an over current condition and to actuate the operating mechanism. An operating mechanism is structured to both open the contacts, either manually or following actuation by the trip device, and close the contacts.

That is, the operating mechanism includes both a closing assembly and an opening assembly, which may have common elements, that are structured to move the movable contact between a first, open position, wherein the contacts are separated, and a second, closed position, wherein the contacts are coupled and in electrical communication. The operating mechanism includes a rotatable pole shaft that is coupled to the movable contact and structured to move each movable contact between the closed position and the open position. Elements of both the closing assembly and the opening assembly are coupled to the pole shaft so as to effect the closing and opening of the contacts.

In the prior art, low and medium voltage electrical switching apparatus operating mechanisms typically had a stored energy device, such as an closing spring, and at least one link coupled to the pole shaft. The at least one link, typically, included two links that acted cooperatively as a toggle assembly. When the contacts were open, the toggle assembly was in a first, collapsed configuration and, conversely, when the contacts were closed, the toggle assembly was, typically, in a second, toggle position, that is, an in-line configuration, or in a slightly over-toggle position. An opening spring biased the pole shaft, and therefore the toggle assembly, to the collapsed position. The spring and toggle assembly were maintained in the second, toggle position by the trip device.

The trip device included an over-current sensor, a latch assembly and may have included one or more additional links that were coupled to the toggle assembly. Alternately, the latch assembly was directly coupled to the toggle assembly. When an over-current situation occurred, the latch assembly was released allowing the opening spring to cause the toggle assembly to collapse. When the toggle assembly collapsed, the toggle assembly link coupled to the pole shaft caused the pole shaft to rotate and thereby move the movable contacts into the open position.

In a low and medium voltage electrical switching apparatus, the force required to close the contacts was, and is, typically greater than what a human may quickly apply and, as such, the operating mechanism typically included a mechanical closing assembly to close the contacts. The closing assembly, typically, included at least one stored energy device, such as a spring, and/or a motor. Closing springs, typically, were about 2 inches in diameter and about 5 to 6 inches in length. These springs were structured to apply a force of about 1000 pounds. A common configuration included a motor that compressed one or more springs in the closing assembly. That is, the closing springs were coupled to a cam roller that engaged a cam coupled to the motor. As the motor rotated the cam, the closing springs were compressed or charged. The toggle assembly also included a cam roller, typically at the toggle joint. The closing assembly further included one or more cams disposed on a common cam shaft with the closing spring cam. Alternatively, depending upon the configuration of the cam, both the closing spring cam roller and the toggle assembly cam roller could engage the same cam. When the closing springs were released, the closing spring cam roller applied force to the associated cam and caused the cam shaft to rotate. That is, the cam roller "operatively engaged" the cam. Rotation of the cam shaft would also cause the cam associated with the toggle assembly cam roller to rotate. As the cam associated with the toggle assembly cam roller rotated, the cam caused the toggle assembly cam roller, and therefore the toggle assembly, to be moved into selected positions and/or configurations. More specifically, the toggle assembly was moved so as to rotate the pole shaft into a position wherein the contacts were closed. Thus, the stored energy from the closing springs was transferred via the cams, cam shaft, toggle assembly, and pole shaft to the contacts.

For example, during a closing procedure the toggle assembly would initially be collapsed and, therefore, the contacts were open. When the closing springs were released, the rotation of the cam associated with the toggle assembly cam roller would cause the toggle assembly to move back into the second, toggle position, thereby closing the contacts. This motion would also charge the opening springs. Prior to closing, the trip device latch would be reset thereby holding the toggle assembly in the second, toggle position. After the contacts were closed, it was common to recharge the closing spring so that, following an over current trip, the contacts could be rapidly closed again. That is, if the closing springs were charged, the contacts could be closed almost immediately without having to wait to charge the closing springs While this configuration is effective, there are a substantial number of components required, each of which requires space to operate within and each of which are subject to wear and tear. Further, certain components are exposed to considerable force, which enhances wear and tear, during operations wherein that particular component is not in use. For example, in this configuration the cam used to charge the closing spring is still engaged with other components during the release of the closing spring. It is this operative engagement that causes enhanced wear and tear.

SUMMARY OF THE INVENTION

The ram assembly set forth herein provides for a spring biased ram body structured to engage and move the toggle assembly. That is, the ram assembly includes a ram body that travels over a, preferably, straight path and engages the toggle assembly. The path may be defined by one or more pins extending through the ram body. One or more springs are coupled to the ram body and bias the ram body toward the toggle assembly. The springs may be conveniently disposed about the pins. In this configuration, the force created by the springs is, essentially, applied directly to the toggle assembly. Accordingly, because the force created by the springs is not transferred via one or more cams, the required force, and therefore the size of the springs, is reduced compared to the prior art. The use of smaller springs and a lesser spring force further reduces both the size of the operating mechanism and the wear and tear on the other operating mechanism components.

Further, in this configuration, the closing springs and ram assembly are charged by the charging assembly which includes a cam, a rocker arm assembly and a close latch assembly. The closing springs and ram assembly are then held in place by these two assemblies. Generally, the rocker arm assembly includes a cam follower as well as a ram body contact point. The rocker arm assembly is structured to pivot at a location adjacent to the ram body and generally in a plane that is parallel to the ram body path of travel. In this configuration and while the cam follower engages the cam surface with an increasing radius, that is, a rising cam slope, rotation of the cam causes the rocker arm to pivot. As the rocker arm moves, the closing springs are compressed. When the charging camshaft rotation approaches the fully charged position, the rising direction of the cam slope, which produced the charging motion on the rocker assembly and the ram assembly, reverses to a very slight downslope. At this point, the force of the closing springs imparts a forward torque on the camshaft. The close latch assembly holds the camshaft, as well as the rocker arm assembly, ram assembly and closing springs, in this charged and ready-to-close position. When the close latch assembly is released, allowing camshaft rotation, a small further rotation of the camshaft produces an abrupt fall in the cam profile, effectively releasing the rocker arm assembly to move away from the ram, and the ram to perform the closing. The abrupt fall in cam profile removes the closing spring load from the camshaft and the rocker arm assembly. Thus, when the closing springs are discharged, the charging assembly is not subject to the violent closing forces involved in delivering the closing energy from the closing springs.

The majority of the cam profile is dedicated to charging the closing springs. However, at the beginning of this profile, immediately after the abrupt fall of the prior closing, the rise in the cam profile is low enough to allow the closing spring to complete the closing travel without pressing the rocker arm assembly cam follower into the cam surface. An alternate stop is provided for the ram assembly without contacting the rocker arm assembly at the end of the ram body path of travel. Further, a stop is provided for the rocker arm assembly, which moves ahead of the ram, to stop without contacting the cam after closing. At the beginning of the subsequent charging cycle, after a small rotation, the rising profile of the cam comes into contact with the rocker arm assembly cam follower and begins moving it. The rocker arm assembly is now allowed to reengage the now discharged ram assembly. The charging assembly is then set to begin another cycle of charging the springs and ram assembly.

Unlike the prior art, in configurations such as this, where the cam must advance a small amount to release the closing springs, and then is no longer engaged in the closing process, the cam is free to continue rotating further under its own inertia after the closing latch assembly has been released. Thus, there is a chance that the cam may over-rotate during the period after a release of the closing springs but before the recharging of the closing springs.

If excess over-rotation results from a closing, the cam angle will not be aligned such that the low cam profile will allow the rocker to reach its stop. The rocker arm assembly cam follower will contact the cam surface where the profile is rising for charging, with potentially damaging impact, rather that the rocker contacting its alternate stop. Furthermore, rocker arm assembly movement, and in turn, ram movement will be interrupted before closing travel has been completed, resulting in a incomplete closure.

To prevent such an over rotation a catchment mechanism is provided. The catchment mechanism includes a catchment wheel, a catchment prop, and a catchment prop reset pin. The catchment wheel is fixed to the cam shaft and rotates in a fixed relationship to the cam. The catchment wheel has a generally smooth outer surface with a step, that is, a radially extending surface. The catchment prop is pivotally coupled to the housing assembly and is aligned with the catchment wheel. The catchment prop includes a stop edge. The catchment prop is positioned by the catchment prop reset pin so that the stop edge is disposed adjacent to the catchment wheel outer surface. The catchment prop reset pin is also structured to move the stop edge out of engagement with the catchment wheel radially extending surface.

In this configuration, the catchment wheel rotates with the cam as the closing springs are being charged. During the charging of the springs, the catchment prop stop edge travels over, but preferably does not engage, the wheel outer surface. When the closing springs are released, the catchment prop stop edge engages the catchment wheel radially extending surface thus causing the catchment wheel to stop rotating. As the catchment wheel is fixed to the cam shaft, the rotation of the cam shaft, and therefore the cam, is also stopped. The catchment wheel radially extending surface is positioned so that the cam is stopped in an appropriate position to begin charging the closing spring.

The catchment prop reset pin is disposed on the rocker arm assembly and is structured to lift the catchment prop stop edge over the catchment wheel radially extending surface. That is, the catchment prop includes a reset pocket having two generally flat surfaces. The catchment prop reset pin travels within the pocket and operatively engages both flat surfaces. The flat surface adjacent to the catchment wheel is a reset surface. After the closing springs are released, and the cam shaft over-rotates and the catchment prop stop edge engages the catchment wheel radially extending surface and arrests the motion of the cam shaft. As the catchment prop reset pin is disposed on the rocker arm assembly, this motion causes the catchment prop reset pin to move toward, then operatively engage, the reset surface. After the motion of the ram and the rocker arm are substantially complete, the reset surface is operatively engaged, the catchment prop is pivoted so that the catchment prop stop edge no longer engages the catchment wheel radially extending surface. Thus, when the closing spring charging procedure begins, the catchment wheel is free to rotate. The catchment prop pocket flat surface distal to the catchment wheel is a positioning surface. During the charging procedure, the cam rotates and causes the rocker arm assembly to pivot. As the rocker arm assembly pivots, the catchment prop reset pin is moved to the other end of the pocket and operatively engages the positioning surface. When the positioning surface is engaged by the catchment prop reset pin, the catchment prop is pivoted about its pivot point until the stop edge is again disposed adjacent to the catchment wheel outer surface. Thus, the catchment prop is again positioned so that, upon release of the closing springs, the catchment prop stop edge engages the catchment wheel radially extending surface.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components so coupled move as one.

As used herein, "operatively engage" when used in relation to a component that is directly coupled to a cam means that a force is being applied by that component to the cam sufficient to cause the cam to rotate. "Operatively engage" is also synonymous with the phrase "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver merely engages the screw. However, when a rotational force is applied to the screwdriver, the screwdriver operatively engages the screw and causes the screw to rotate.

Figure 1:
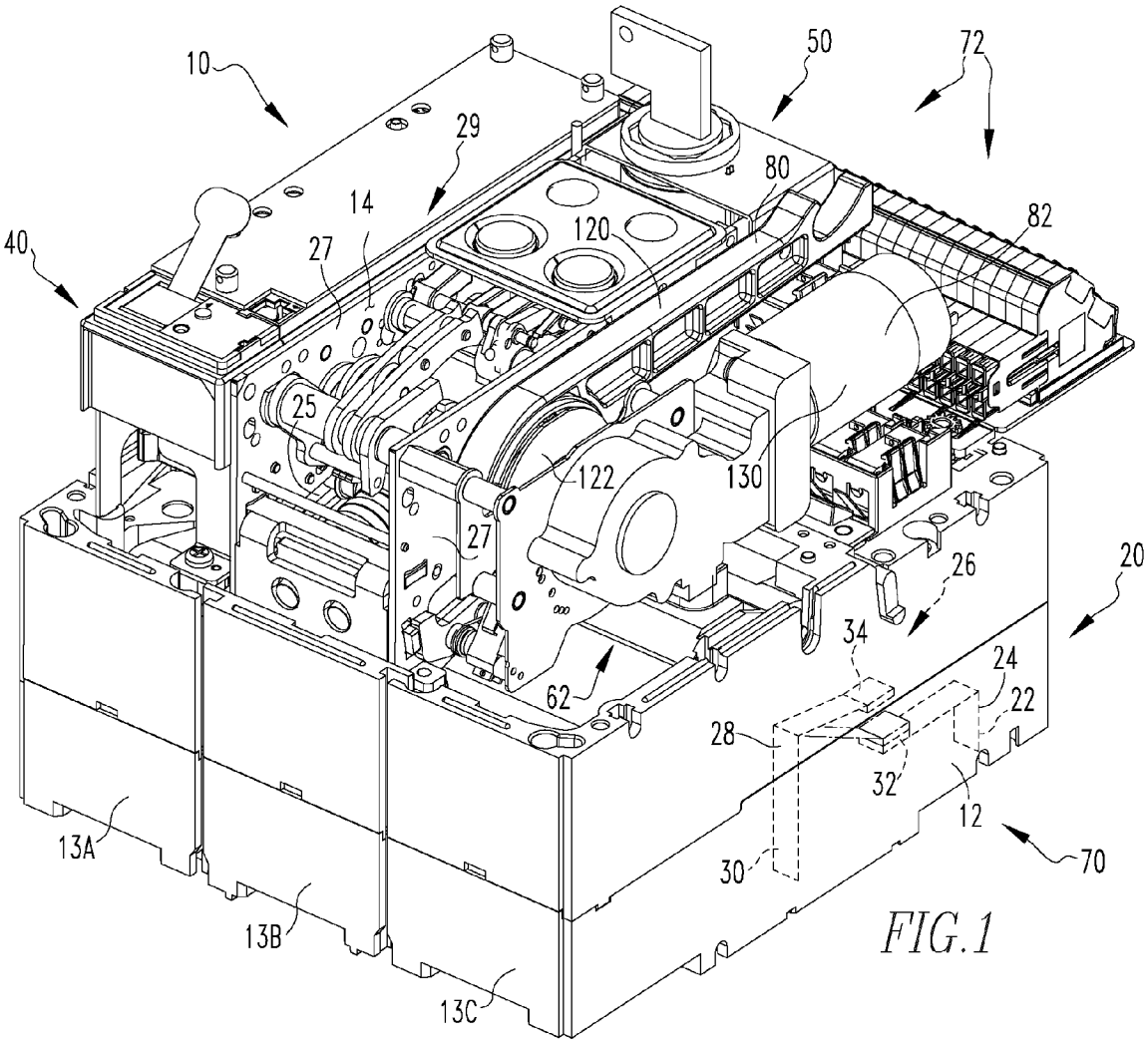
FIG. 1 is an isometric view of an electrical switching apparatus with a front cover removed.

As shown in FIG. 1, an electrical switching apparatus 10 includes a housing assembly 12 defining an enclosed space 14. In FIG. 1, the front cover of the housing assembly 12 is not shown, but it is well known in the art. The electrical switching apparatus 10 further includes a conductor assembly 20 (shown schematically) having at least one line terminal 22, at least one line conductor 24, at least one pair of separable contacts 26, at least one load conductor 28 and at least one load terminal 30. The at least one pair of separable contacts 26 include a fixed contact 32 and a movable contact 34. The movable contact 34 is structured to move between a first, open position, wherein the contacts 32, 34 are separated, and a second, closed position, wherein the contacts 32, 34 contact each other and are in electrical communication. The electrical switching apparatus 10 further includes a trip device 40 and an operating mechanism 50. The operating mechanism 50, which is discussed in more detail below, is generally structured to move the at least one pair of separable contacts 26 between the first, open position and the second, closed position. The trip device 40 is structured to detect an over current condition and, upon detecting such a condition, to actuate the operating mechanism 50 to open the at least one pair of separable contacts 26.

The electrical switching apparatus 10 also includes at least two, and typically a plurality, of side plates 27. The side plates 27 are disposed within the housing assembly 12 in a generally parallel orientation. The side plates 27 include a plurality of openings 29 to which other components may be attached or through which other components may extend. As discussed below, the openings 29 on two adjacent side plates 27 are typically aligned. While side plates 27 are the preferred embodiment, it is understood that the housing assembly 12 may also be adapted to include the required openings and/or attachment points thereby, effectively, incorporating the side plates 27 into the housing assembly 12 (not shown).

An electrical switching apparatus 10 may have one or more poles, that is, one or more pairs of separable contacts 26 each having associated conductors and terminals. As shown in the Figures the housing assembly 12 includes three chambers 13A, 13B, 13C each enclosing a pair of separable contacts 26 with each being a pole for the electrical switching apparatus 10. A three-pole configuration, or a four-pole configuration having a neutral pole, is well known in the art. The operating mechanism 50 is structured to control all the pairs of separable contacts 26 within the electrical switching apparatus 10. Thus, it is understood selected elements of the operating mechanism 50, such as, but not limited to, the pole shaft 56 (discussed below) span all three chambers 13A, 13B, 13C and engage each pair of separable contacts 26. The following discussion, however, shall not specifically address each specific pair of separable contacts 26.

As shown in FIG. 2, the operating mechanism 50 includes an opening assembly 52, structured to move the at least one pair of separable contacts 26 from the second, closed position to the first, open position, and a closing assembly 54, structured to move the at least one pair of separable contacts 26 from the first, open position to the second closed position. The opening assembly 52 and the closing assembly 54 both utilize common components of the operating mechanism 50. The opening assembly 52 is not part of the claimed invention, however, for the purpose of the following discussion, it is understood that the opening assembly 52 is the assembly structured to move various components to the positions discussed below. Further, it is noted that the opening assembly 52 includes a cradle assembly 53 that, among other functions, acts as a toggle stop and as a toggle kicker for the toggle assembly 58 (discussed below).

Figure 2A:
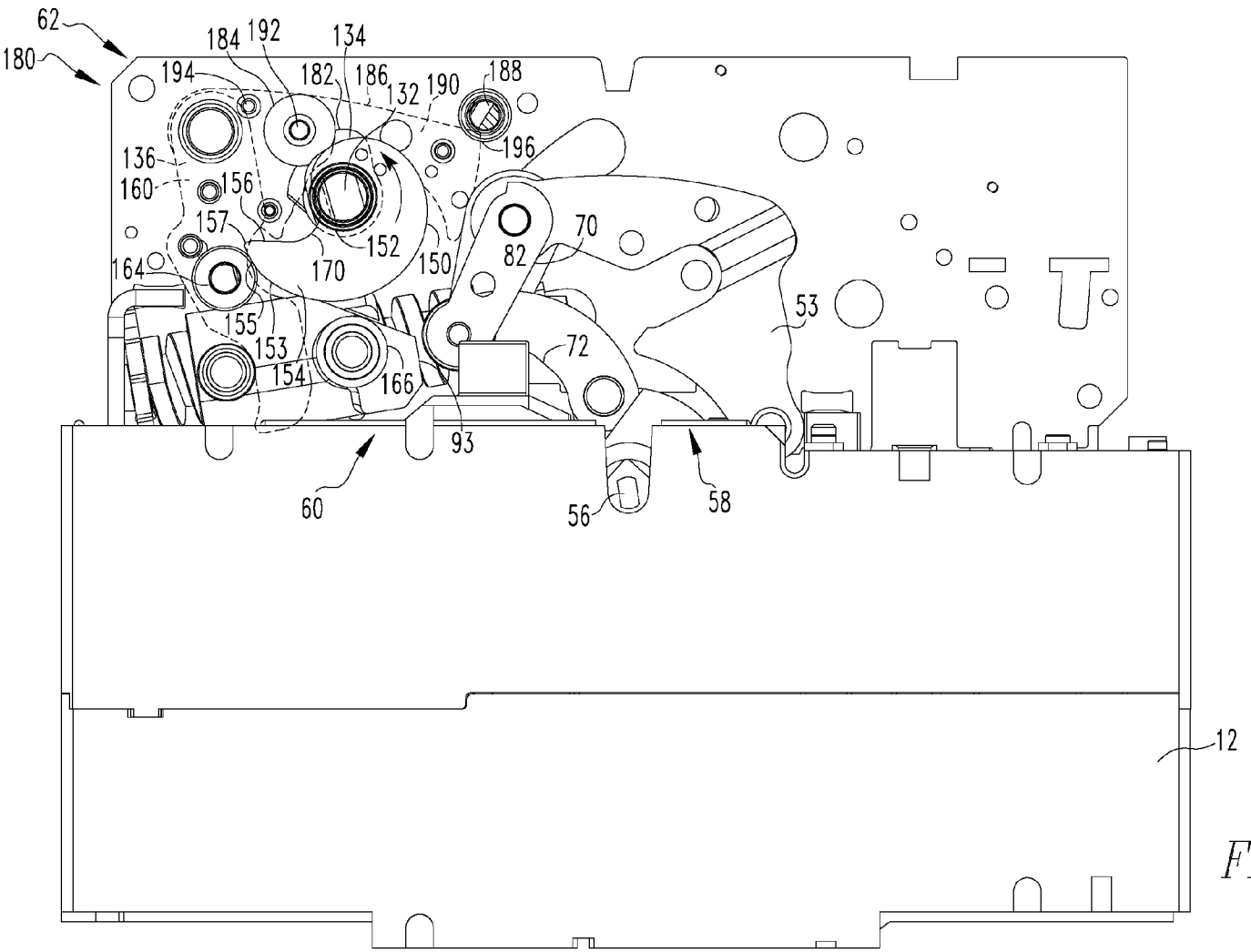
FIG. 2A is a side view of an electrical switching apparatus with a front cover removed and selected components removed for clarity and with the latch assembly in a first position.
Figure 2B:
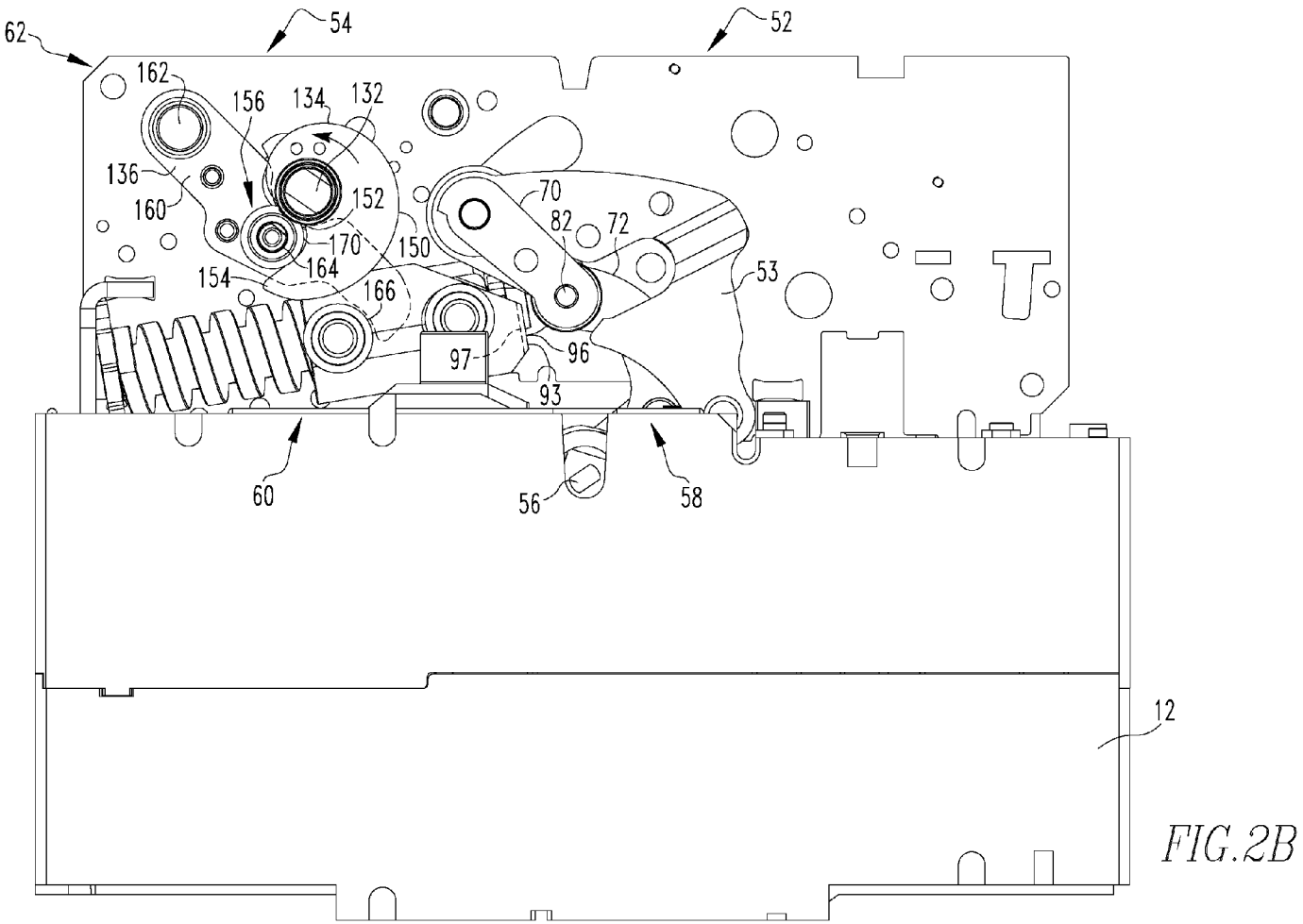
FIG. 2B is a side view of an electrical switching apparatus with a front cover removed and selected components removed for clarity and with the latch assembly in a second position.
Figure 3:
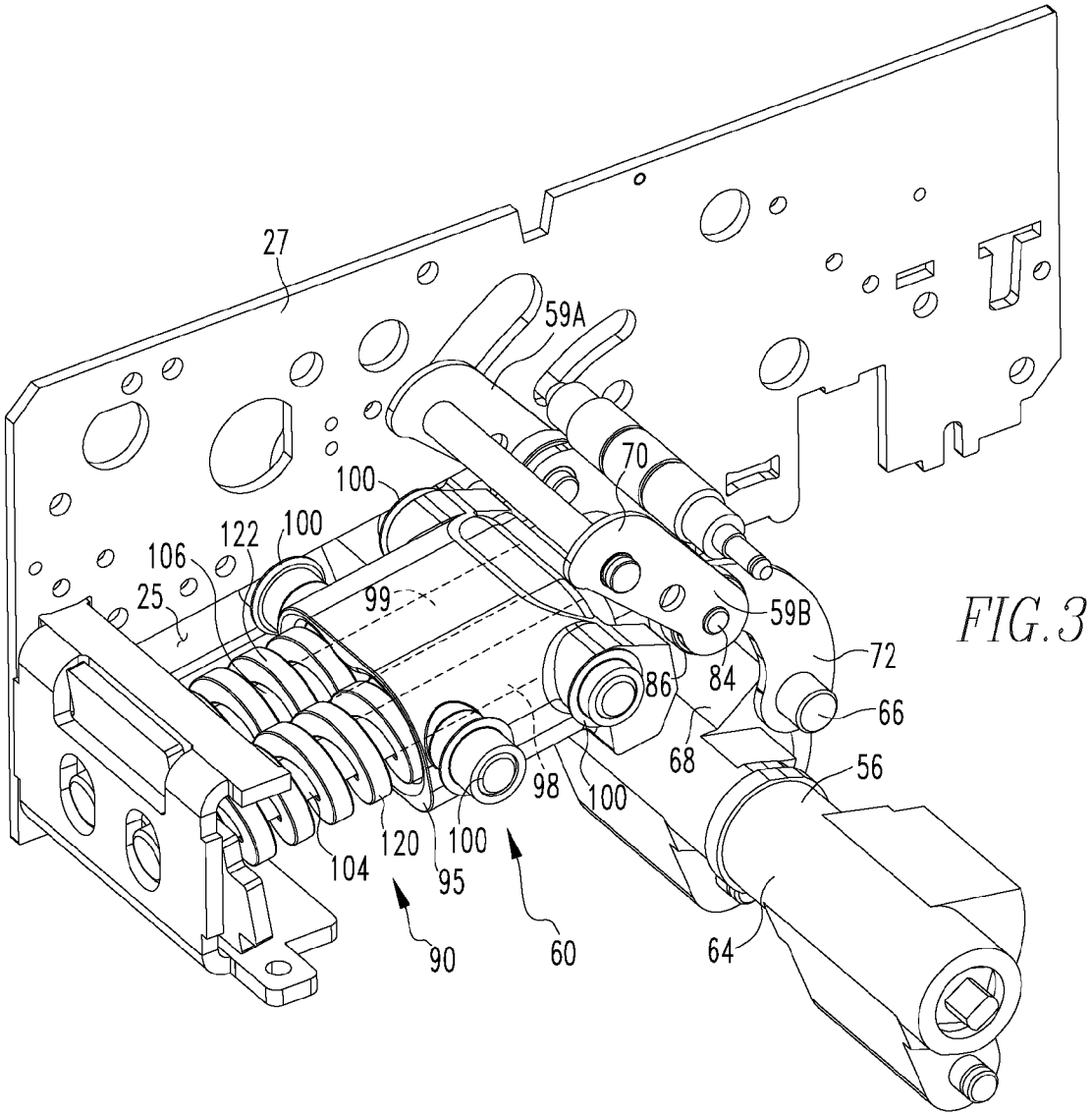
FIG. 3 is an isometric view of the closing assembly with a side plate removed for clarity.
Figure 4:
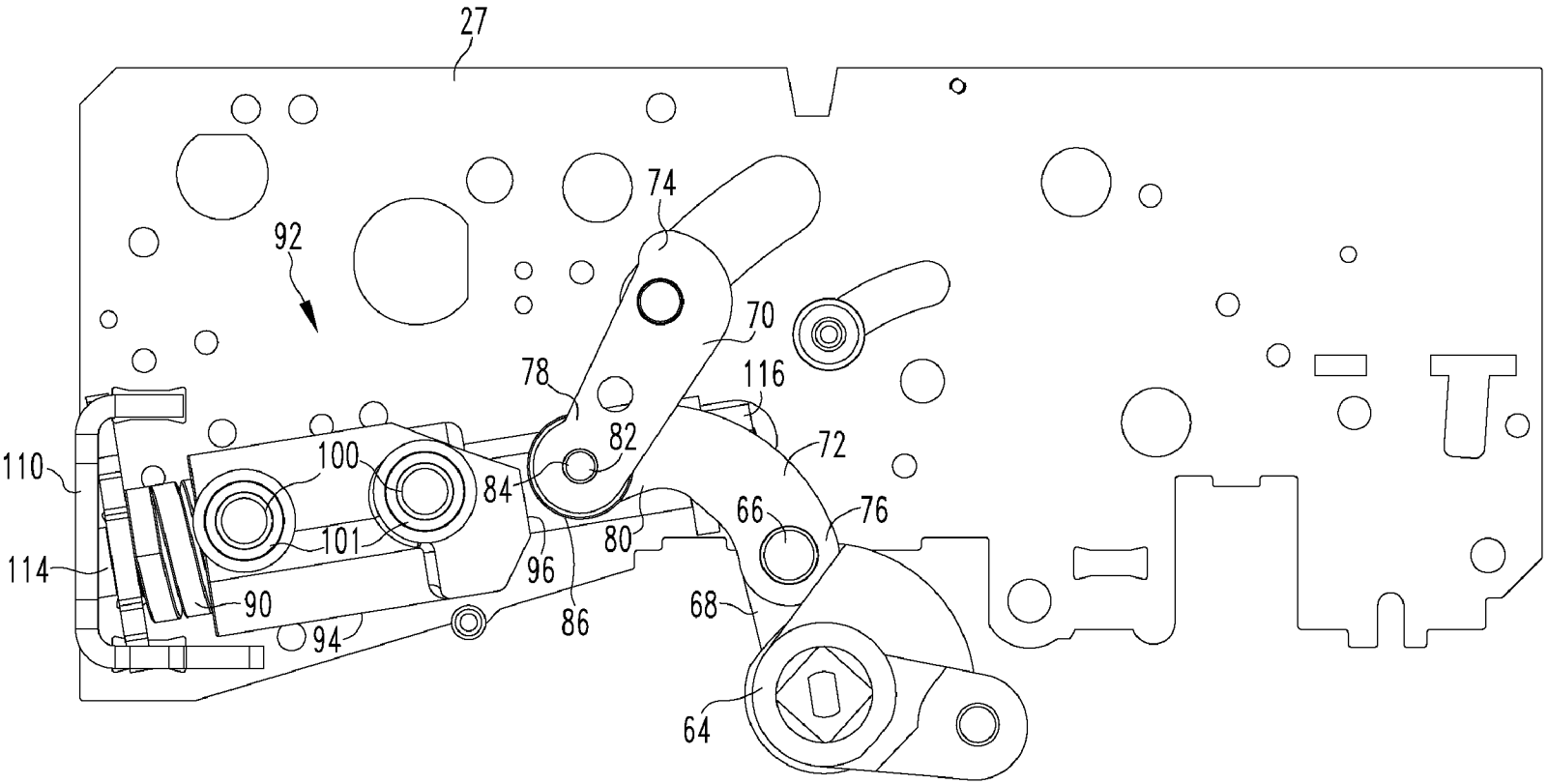
FIG. 4 is a side view of the ram assembly and the toggle assembly in a first position/configuration.

As shown in FIGS. 2-4, the closing assembly 54 includes a pole shaft 56, a toggle assembly 58, a ram assembly 60, and a charging assembly 62 (FIG. 1). The pole shaft 56 is an elongated shaft body 64 rotatably coupled to the housing assembly 12 and/or side plates 27. The pole shaft 56 includes a plurality of mounting points 66 disposed on mounting blocks 68 extending from the pole shaft body 64. The pole shaft 56 is coupled to the movable contact 34. The pole shaft 56 is structured to move between a first position, wherein the movable contact 34 is in its first, open position, and a second position, wherein the movable contact 34 is in its second, closed position.

It is noted that, as shown in FIG. 3, a single "link" in the toggle assembly 58 may include two, or more, members 59A, 59B with similar shapes which are held in a spaced relationship and which move in concert. The use of multiple link members 59A, 59B may be used, for example, to provide added strength to the link or where space considerations do not allow for a single thick link. Because these link members 59A, 59B perform the same function, have a similar shape, and move in concert, the following discussion will simply identify the link by a single reference number as is shown in the side views of FIGS. 4 and 5. It is understood that the description of a link applies to both link members 59A, 59B.

Figure 5:
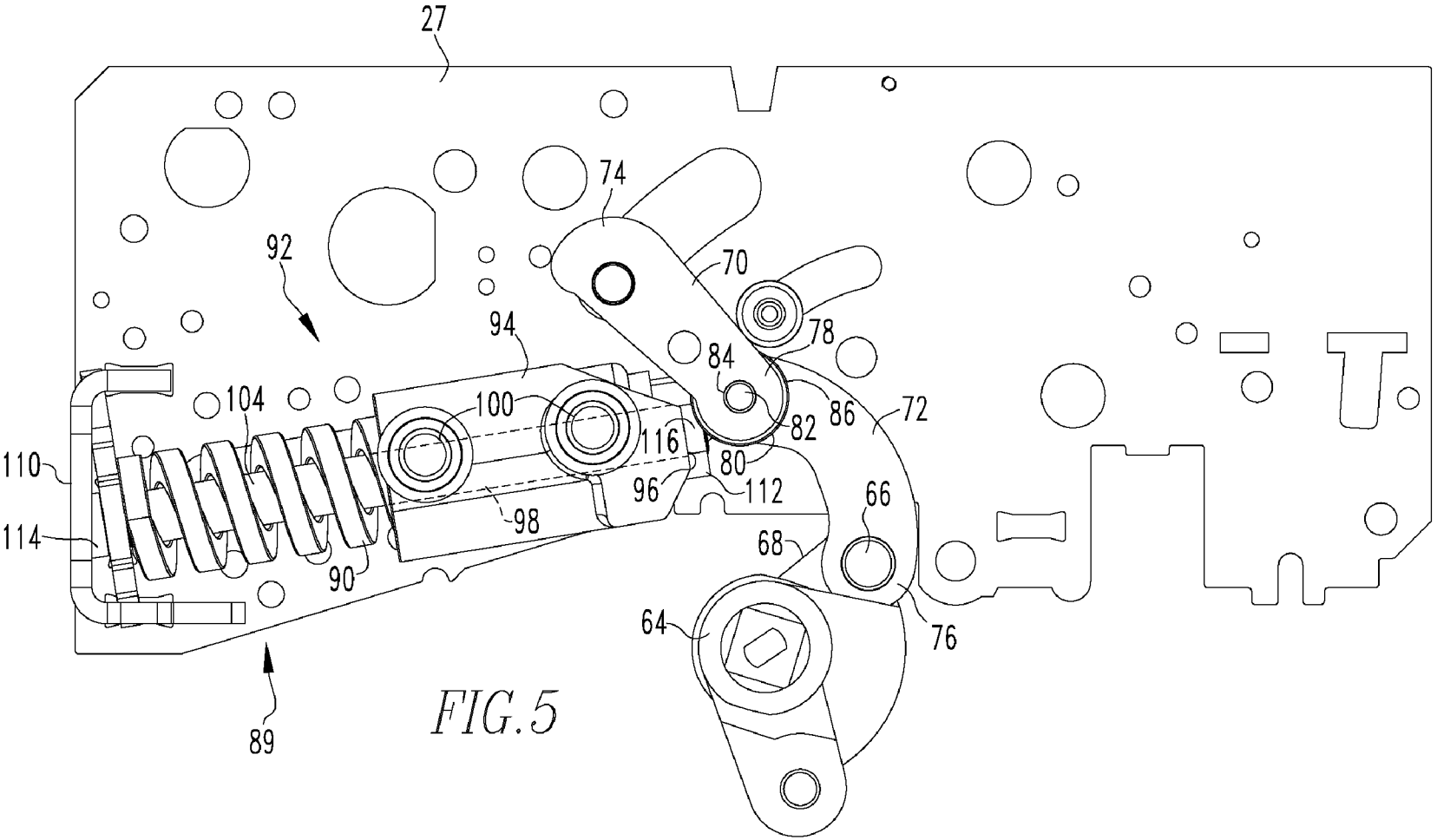
FIG. 5 is a side view of the ram assembly and the toggle assembly in a second position/configuration.

As shown in FIGS. 4 and 5, the toggle assembly 58 includes a first link 70 and a second link 72 which are each generally flat, elongated bodies. The first and second links 70, 72 each have a first, outer end 74, 76 (respectively) and a second, inner end 78, 80 (respectively). The first link 70 and the second link 72 are rotatably coupled together at the first link inner end 78 and the second link inner end 80. In this configuration, the first and second links 70, 72 form a toggle joint 82. The toggle joint 82 may include a toggle roller 86. That is, the first link inner end 78 and the second link inner end 80 may be rotatably coupled together by a pin 84 extending generally perpendicular to the plane of each link 70, 72. The pin 84 may also define an axle for the toggle roller 86 which is, essentially, a wheel. The toggle roller 86 has a diameter of sufficient size to extend past the edges of the first and second links 70, 72. The first link outer end 74 is rotatably coupled to the housing assembly 12 and/or side plates 27. For the purpose of this disclosure, the first link outer end 74 may be considered to be a fixed pivot point. The second link outer end 76 is rotatably coupled to the pole shaft 56 and, more specifically, rotatably coupled to a mounting point 66.

The toggle assembly 58 is structured to move between a first, collapsed configuration (FIG. 4) and a second, slightly over-toggle configuration (FIG. 5). In the over-toggle configuration, the toggle assembly 58 is typically between about 5 degrees and 15 degrees past toggle and, preferably about 10 degrees past toggle. In the first, collapsed configuration, the first and second link outer ends 74, 76 are generally closer together than when the toggle assembly 58 is in the second, over-toggle configuration. Thus, because the first link outer end 74 is a fixed pivot point, as the toggle assembly 58 moves between the first, collapsed configuration and the second, over-toggle configuration, the second link outer end 76 is drawn toward, or pushed away from, the first link outer end 74. This motion causes the pole shaft 56 to move between its first and second positions. That is, when the toggle assembly 58 is in the first, collapsed configuration, the pole shaft 56 is in its first position, and, as noted above, the movable contact 34 is in its first, open position. Further, when the toggle assembly 58 is in the second, over-toggle configuration, the pole shaft 56 is in its second position, and, as noted above, the movable contact 34 is in its second, closed position.

The ram assembly 60 has at least one biasing device 89, preferably a compression spring 90, a guide assembly 92, and a ram body 94. The ram body 94, preferably, includes a generally flat forward surface 96 that is structured to engage the toggle joint 82, and more preferably the toggle roller 86. The ram body 94 may be solid but, in a preferred embodiment, the ram body 94 is substantially hollow having a loop-like side wall 95 (FIG. 3) coupled to cap-like a front plate 93 (FIG. 2A). The forward surface 96 is the outer surface of the front plate 93. The ram body 94 is structured to move between a first, retracted position and a second, extended position along a path of travel defined by the guide assembly 92. In one embodiment the ram body 94 has a lateral width of about 2.1 inches and defines at least one, and preferably two passages 98, 99 (FIG. 3) extending in the direction of the path of travel. The ram body 94 may also have at least one, and preferably two rollers 100 disposed on opposite lateral sides of the ram body 94. The passages 98, 99 and the ram rollers 100 cooperate with an associated embodiment of the guide assembly 92. That is, for this embodiment, the guide assembly 92 includes at least one, and preferably two elongated, generally straight pins 104, 106 (FIG. 3) that are disposed in a spaced, generally parallel orientation. Further, the housing assembly 12 and/or side plates 27 may define slots 25 disposed on either side of the ram body 94 path of travel. When assembled, the pins 104, 106 extend through the passages 98, 99 and the ram body rollers 100 are each disposed in one of the slots 25. In this configuration, the ram body 94 is limited to a generally linear motion defined by the guide assembly 92.

The guide assembly 92 further includes a base plate 110 and a stop plate 112. Each pin 104, 106 has a base end 114 and a tip end 116. Each pin base end 114 is coupled to the base plate 110 and each pin tip end 116 is coupled to the stop plate 112 (FIG. 5). That is, the base plate 110 and the stop plate 112 maintain the pins 104, 106 in a spaced, generally parallel configuration. Further, in the embodiment described above, the base plate 110 and the stop plate 112 further limit and define the ram body 94 path of travel. That is, the ram body 94 is trapped between the base plate 110 and the stop plate 112.

The at least one spring 90 is structured to bias the ram body 94 from the first, retracted position toward the second, extended position. When the ram body 94 is in the first, retracted position, the at least one spring 90 is charged or compressed. When the ram body 94 is in the second, extended position, the at least one spring 90 is discharged. Preferably, the at least one spring 90 is disposed between the base plate 110 and a ram body back surface 97 (FIG. 2B). The ram body back surface 97 is, preferably, the interior side of the front plate 93. That is, the ram body back surface 97 is disposed on the opposite side of the front plate 93 from the forward surface 96. In the embodiment disclosed above, i.e., a ram body 94 with two passages 98, 99 and two pins 104, 106, the at least one spring 90 is preferably two springs 120, 122 and each spring 120, 122 is disposed about one of the two pins 104, 106. For a 600 volt electrical switching apparatus, wherein the closing energy required to close three pairs of contacts 26 is as much as 50 joules, the springs 120, 122 may each be about 3.5 inches long and about 0.75 inches in diameter.

As shown in FIGS. 1 and 2, the charging assembly 62 includes a charging operator 130, a cam shaft 132, a cam 134, and a rocker arm assembly 136. The charging operator 130 is a device coupled to, and structured to rotate, the cam shaft 132. The charging operator 130 may be a manually powered handle assembly 140 and/or a powered motor 142 as shown in FIG. 1. The cam shaft 132 is an elongated shaft that is rotatably coupled to the housing assembly 12 and/or side plates 27. The cam 134 is fixed to the cam shaft 132 and structured to rotate therewith about a pivot point. The cam 134 includes an outer cam surface 150. The outer cam surface 150 has a point of minimal radius 152, a point of greatest radius 154, and a stop radius 155. The cam 134 is structured to rotate in a single direction as indicated by the arrow in FIG. 2. The outer cam surface 150 increases gradually in radius from the point of minimal radius 152 to the point of greatest radius 154 in the direction of rotation. After the cam point of greatest radius 154, the radius of the outer cam surface 150 is reduced slightly over a downslope 153. The downslope 153 leads to a stop radius 155 and then a tip 157. As set forth below, the downslope 153 to the stop radius 155 is a surface to which the force from the at least one spring 90 is applied and which encourages rotation in the proper direction so that when the "close latch" releases the cam shaft 132 rotates from the stop radius 155 to the cam tip 157 where the cam follower 164 falls off the cam tip 157 and into the pocket of the cam 134. As is shown, the outer cam surface point of minimal radius 152 and the outer cam tip 157 are disposed immediately adjacent to each other on the outer cam surface 150. Thus, there is a step 156 between the point of minimal radius 152 and the cam tip 157. It is further noted that, due to the radius of the cam follower 164 (discussed below) the cam follower 164 does not engage the point of minimal radius 152, but rather engages a stop adjacent to the point of minimal radius 152.

The rocker arm assembly 136 includes an elongated body 160 having a pivot point 162, a cam follower 164, and a ram body contact point 166. The rocker arm assembly body 160 is pivotally coupled to housing assembly 12 and/or side plates 27 at the rocker arm body pivot point 162. The rocker arm assembly body 160 may rotate about the rocker arm body pivot point 162 and is structured to move between a first position, wherein the rocker arm body ram body contact point 166 is disposed adjacent to the base plate 110, and a second position, wherein the rocker arm body ram body contact point 166 is adjacent to the stop plate 112. As used immediately above, "adjacent" is a comparative adjective relating to the positions of the rocker arm assembly body 160. The rocker arm body ram body contact point 166 is structured to engage and move the ram body 94. As shown, the rocker arm body ram body contact point 166 engages a bearing 101 (FIG. 3) disposed about the axle of one of the ram body rollers 100. The rocker arm assembly body 160 moves within a plane that is generally parallel to the ram body 94 path of travel and, more preferably, in a plane generally parallel to the plane of the side plates 27. The rocker arm body cam follower 164 extends generally perpendicular to the longitudinal axis of the rocker arm assembly body 160 and is structured to engage the outer cam surface 150. The rocker arm body cam follower 164 may include a roller 170.

The closing assembly 54 is assembled in the housing assembly 12 as follows. The toggle assembly 58 is disposed with the first link outer end 74 being rotatably coupled to the housing assembly 12 and/or side plates 27. The second link outer end 76 is rotatably coupled to the pole shaft 56 and, more specifically, rotatably coupled to a mounting point 66. The ram assembly 60 is disposed adjacent to the toggle assembly 58 with the ram body forward surface 96 adjacent to the toggle joint 82. That is, the toggle assembly 58 and the ram assembly 60 are positioned relative to each other so that the toggle joint 82 is disposed within the ram body 94 path of travel. More specifically, the toggle joint 82 also moves through a path as the toggle assembly 58 moves between the first, collapsed configuration and the second, over-toggle configuration. The path of the toggle joint 82 is disposed, generally, within the ram body 94 path of travel. Thus, the ram body 94 is structured to engage the toggle joint 82. In a preferred embodiment, the ram body 94 path of travel does not extend to the position of the toggle joint 82 when the toggle assembly 58 is in the second, over-toggle configuration.

The rocker arm assembly 136 assembly is disposed within the housing assembly 12 adjacent to the ram assembly 60. More specifically, the rocker arm body ram body contact point 166 is disposed so as to contact the forward side, that is the side opposite the at least one spring 90, of a ram body roller 100. In this configuration, rotation of the cam 134 causes the ram body 94 to move between the second, extended position and the first, retracted position. That is, assuming the ram body 94 is in the second, extended position and the cam follower 164 is disposed on the outer cam surface 150 at a point adjacent to the outer cam surface point of minimal radius 152, then the rocker arm assembly body 160 is in the second position. Upon actuation of the charging operator 130, the cam shaft 132 and the cam 134 rotate causing the cam follower 164 to move over the outer cam surface 150. At the point where the cam follower 164 engages the outer cam surface 150, the relative radius of the outer cam surface 150 increases with the continued rotation. As the relative radius of the outer cam surface 150 is increasing the rocker arm assembly body 160 is moved to the first position. As the rocker arm assembly body 160 is moved to the first position, the rocker arm body ram body contact point 166 engages the ram body bearing 101 and moves the ram body 94 to the first position, thereby compressing the at least one spring 90. When the ram body 94 is moved to the first position, the rocker arm body cam follower 164 is disposed at the stop radius 155. When the rocker arm body cam follower 164 is disposed on the stop radius 155, the force from the at least one spring 90 is transferred via the ram body 94 and the rocker arm assembly body 160 to the cam 134. That is, the force is being applied in a generally radially inward direction Because the cam radius at the stop radius 155 is less than at the cam point of greatest radius 154, the cam 134 is encouraged to rotate away from the cam point of greatest radius 154, i.e. toward the step 156. The rotation of the cam shaft 132 is controlled by the latch assembly 180, discussed below.

In this position, any further rotation of the cam 134 will allow the rocker arm body cam follower 164 to fall over the step 156. After the rocker arm body cam follower 164 falls over the step 156, the rocker arm body cam follower 164 does not operatively engage the cam 134. That is, while there may be some minor force applied to the cam 134 by the rocker arm body cam follower 164, this force is not significant, does not cause the cam 134 to rotate, and does not cause significant wear and tear on the cam 134. It is noted that the cam 134 may rotate due to momentum imparted by the rocker arm body cam follower 164 prior to the rocker arm body cam follower 164 to falling over the step 156. Further, as the rocker arm body cam follower 164 falls over the step 156, the rocker arm assembly body 160 is free to move to the second position as the rocker arm body cam follower 164 is now disposed adjacent to the outer cam surface point of minimal radius 152. It is observed that, when the rocker arm body cam follower 164 is disposed at the outer cam surface stop radius 155, the cam 134 engaging the rocker arm assembly 136, which further engages the ram assembly 60, maintains the at least one spring 90 in the charged state.

The cam 134 and the rocker arm assembly 136 are maintained in the charged configuration by a latch assembly 180. The latch assembly 180 includes a latch lobe 182, a latch roller 184, latch prop 186 and a latch D-shaft 188. The latch lobe 182 is fixed to the cam shaft 132 and maintains a specific orientation relative to the cam 134. The latch roller 184 is rotatably coupled to the latch prop 186 and is structured to roll over the surface of the latch lobe 182. The latch prop 186 has an elongated, generally flat body 190 having a latch roller 184 mounting 192, a pivot point 194 and a latch edge 196. The latch prop body 190 is pivotally coupled to a side plate 27 and is structured to pivot, or rock, between a first position (FIG. 2A) and a second position (FIG. 2B). In the first position, the latch edge 196 engages the outer diameter of the latch D-shaft 188 and is held in place thereby. In turn, the latch roller 184 is held in place against the latch lobe 182 and prevents the cam shaft 132 from rotating. The latch D-shaft 188 is structured to rotate in response to a user input, e.g. actuation of a solenoid (not shown). When the latch D-shaft 188 rotates, the latch edge 196 passes over the latch D-shaft 188 as is known in the art. This allows the latch prop body 190 to move into the second position. When the latch prop body 190 is in the second position, the latch roller 184 does not engage the latch lobe 182 and, due to the bias of the at least one spring 90, as discussed above, the cam shaft 132 will rotate.

In this configuration, the closing assembly 54 operates as follows. For the sake of this discussion the electrical switching apparatus 10 will be initially described in the typical condition following an over current condition. That is, the at least one pair of separable contacts 26 are in the first, open position, the pole shaft 56 is in the first position, the toggle assembly 58 is in the first configuration, the ram body 94 is in the first position and the at least one spring 90 is charged, and the rocker arm assembly body 160 is in the first position. To close the at least one pair of separable contacts 26, an operator actuates the latch assembly 180 to cause the latch D-shaft 188 to rotate as set forth above. When the cam shaft 132 is no longer retained by the latch assembly 180, the cam 134 rotates slightly so as to allow the rocker arm body cam follower 164 to fall over the step 156. When the rocker arm body cam follower 164 falls over the step 156, the rocker arm assembly body 160 is free to move to the second position as the rocker arm body cam follower 164. The rocker arm assembly body 160 preferably engages a stop (not shown) that positions the rocker arm assembly body 160 adjacent the outer cam surface 150 at a point adjacent to the outer cam surface point of minimal radius 152. At this point the at least one spring 90 is no longer restrained and the at least one spring 90 moves the ram body 94 from the first, retracted position toward the second, extended position. It is noted that the rocker arm assembly body 160 stop is positioned so as to allow the ram body 94 to travel over its full path of travel.

As the ram body 94 moves from the first, retracted position toward the second, extended position, the ram body forward surface 96 engages the toggle joint 82 and causes the toggle assembly 58 to move from the first, collapsed configuration to the second, over-toggle configuration. As noted above, the ram body 94 path of travel does not extend to the position of the toggle joint 82 when the toggle assembly 58 is in the second, over-toggle configuration. Preferably, the ram body 94 moves with sufficient speed and energy so that, when the ram body 94 reaches the end of the path of travel, the toggle assembly 58 is over toggle but not at its final over toggle resting point. Once the toggle assembly 58 is over the toggle point, the forces of the at least one spring 90 and whatever the remaining momentum created by the ram body 94 continue the motion of the toggle assembly 58 towards the second, over-toggle configuration, thereby creating a space between the ram body forward surface 96 and the toggle joint 82.

As the toggle assembly 58 is moved into the second, over-toggle configuration, the pole shaft 56 is also moved into its second position. As the pole shaft 56 is moved into its second position, the at least one pair of separable contacts 26 are moved from the first, open position to the second closed position. At this point the closing operation is complete, however, it is preferred that the user again engages the charging operator 130 so that the at least one spring 90 is charged and ready to close the at least one pair of separable contacts 26 following another over current condition.

That is, when the user engages the charging operator 130, the cam 134 rotates and the rocker arm body cam follower 164 again operatively engages and travels over the outer cam surface 150. As the outer cam surface 150 increases in radius, the rocker arm assembly body 160 is moved from the second position to the first position. During this motion the rocker arm assembly body 160 is moving in a charging direction. As set forth above, the rocker arm assembly 136 is structured to be selectively coupled to, and operatively engage, the ram assembly 60 so that movement of the rocker arm assembly 136 in the charging direction causes the ram assembly 60 to move from the second position to the first position which, in turn, compresses the at least one spring 90.

Figure 6:
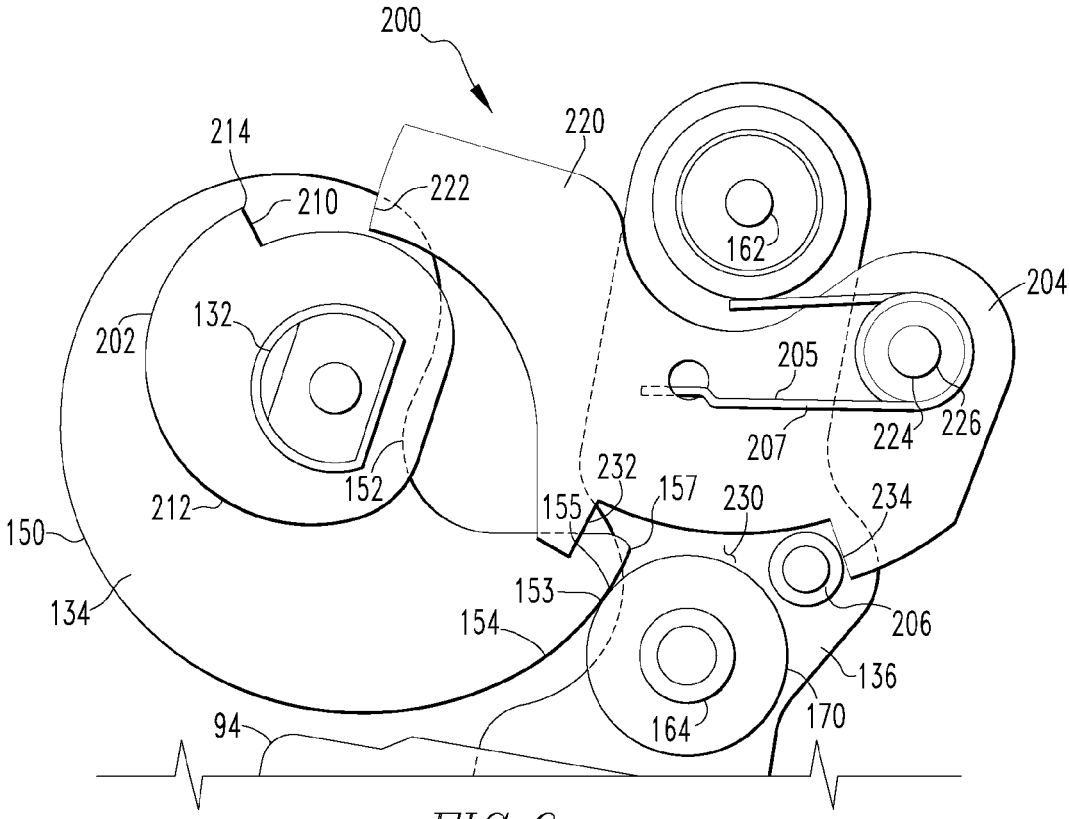
FIG. 6 is a schematic side view of the catchment mechanism prior to releasing the closing spring.
Figure 7:
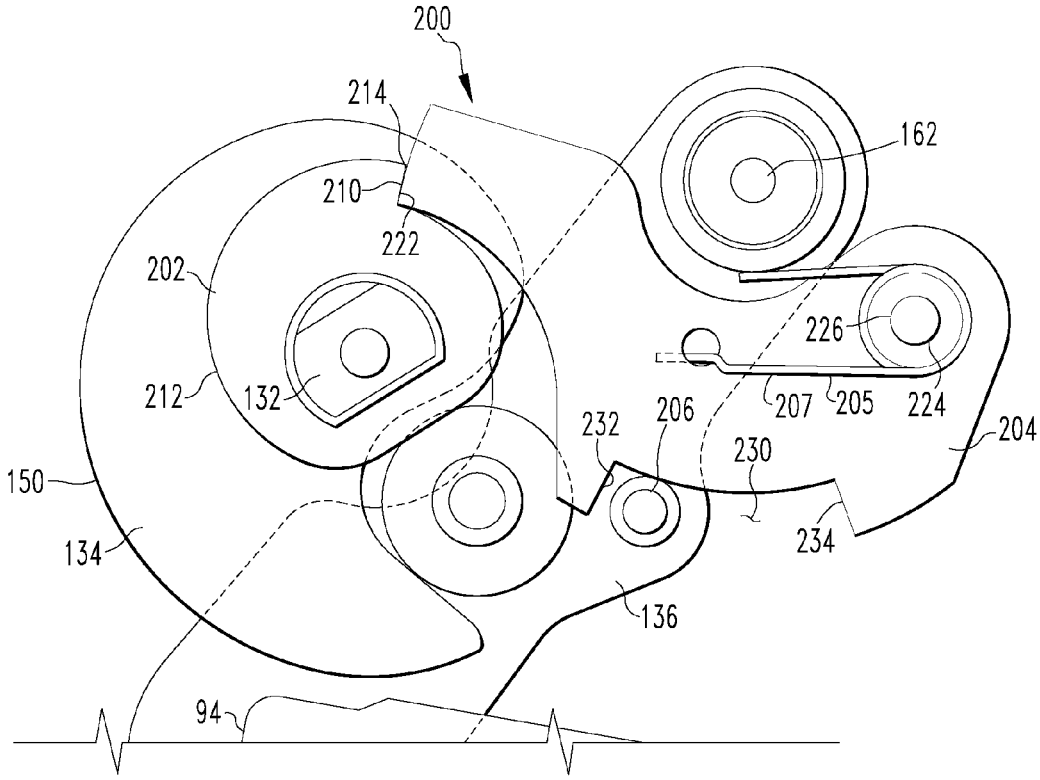
FIG. 7 is a schematic side view of the catchment mechanism immediately after the releasing of the closing spring, but prior to the movement of the rocker arm assembly (rocker arm assembly removed for clarity).
Figure 8:
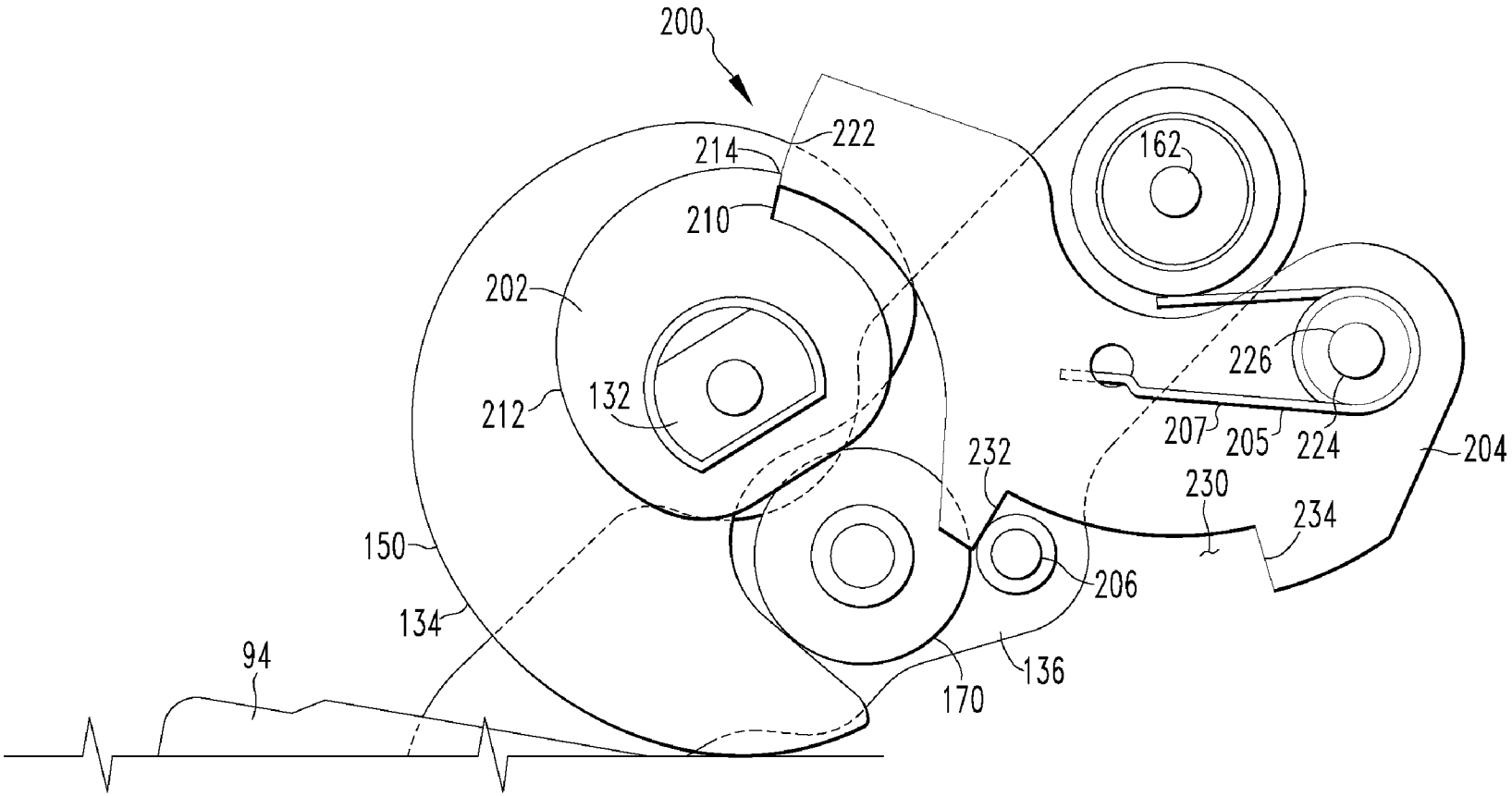
FIG. 8 is a schematic side view of the catchment mechanism immediately after the releasing of the closing spring, and just prior to the movement of the rocker arm assembly reaching the second position.

The closing assembly 54 may further include a catchment mechanism 200, as shown in FIGS. 6-8, having a catchment wheel 202, a catchment prop 204, a positioning spring 205, and a catchment prop reset pin 206. The catchment wheel 202 is a body having a radially extending surface 210. That is, the catchment wheel 202, preferably, has a outer surface 212 with a variable radius. The catchment wheel radially extending surface 210 has a distal tip 214 that is a point of maximum radius. The catchment wheel outer surface 212 is, preferably, not a camming surface and, as such, the catchment wheel outer surface 212 may have any contour. Preferably, the catchment wheel outer surface 212 gradually decreases from the maximum radius at the catchment wheel radially extending surface distal tip 214 to a point of a minimal radius generally on the opposite side of the catchment wheel 202. The catchment wheel outer surface 212 may have a generally constant radius from the point of a minimal radius to the proximal end of the radially extending surface 210. The catchment wheel 202 is structured to be fixed to the cam shaft 132.

It is noted that, because the catchment wheel 202 is fixed to the cam shaft 132 and because the catchment wheel outer surface 212 may have any contour, the catchment wheel 202 may be incorporated into the cam shaft 132. That is, for example, a radially extending pin (not shown) may be coupled to the cam shaft 132. In this configuration, the portion of the cam shaft 132 to which the pin is coupled defines the catchment wheel 202 and the pin defines the radially extending surface 210. Use of a catchment wheel 202 that is a separate body from the cam shaft 132 is preferred as such a configuration is more robust.

Figure 9:
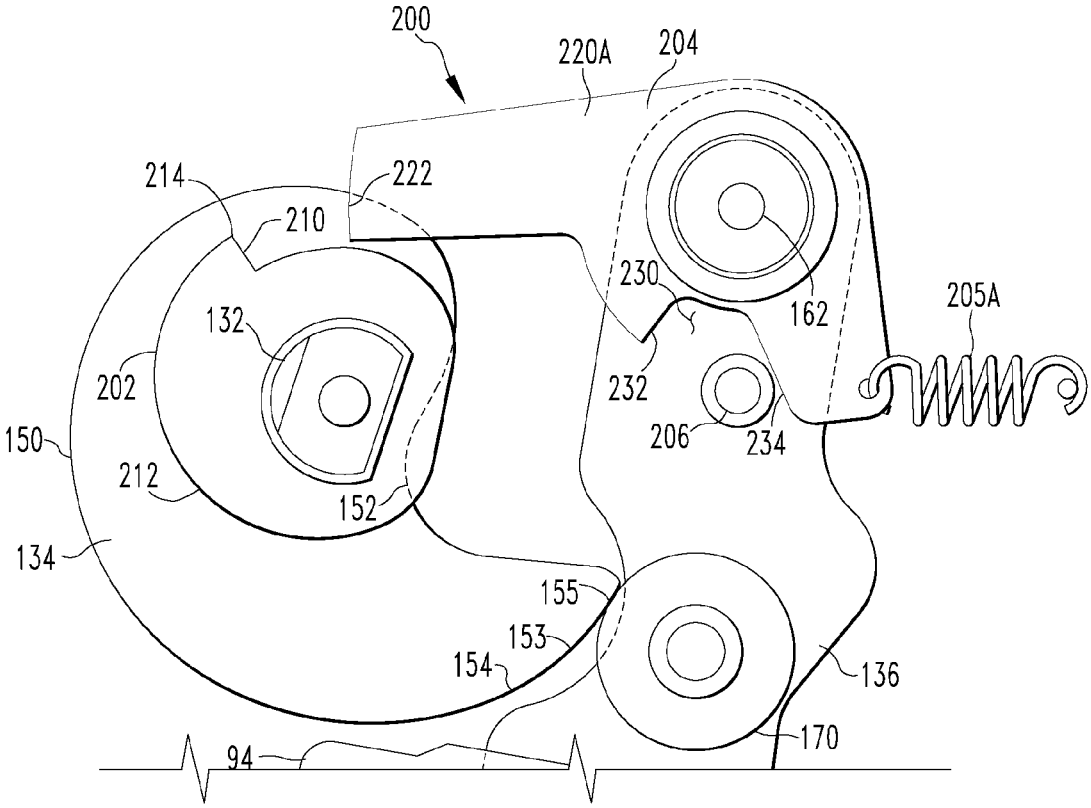
FIG. 9 is a schematic side view of the catchment mechanism prior to releasing the closing spring.

The catchment prop 204 has a body 220, which is preferably elongated, with a stop edge 222 and a pivot point 224. The catchment prop body 220 is structured to be pivotally coupled to the housing assembly 12, preferably by a shaft 226 that is rotatably coupled to the side plates 27 and which is coupled to the catchment prop body 220 at the catchment prop body pivot point 224. Alternatively, and as shown in FIG. 9, the catchment prop body 220A may be pivotally coupled to the housing assembly 12 at the rocker arm body pivot point 162 and may have a positioning spring 205A extending to the housing assembly 12. The catchment prop body 220 is aligned with the catchment wheel 202 and the catchment prop stop edge 222 is positioned to selectively engage the catchment wheel radially extending surface 210. That is, the catchment prop body 220 is structured to move between a stop position, wherein the catchment prop stop edge 222 is positioned to engage the catchment wheel radially extending surface 210, and a reset position, wherein the catchment prop stop edge 222 is spaced from the catchment wheel outer surface 212. The catchment assembly spring 205 is structured to maintain the prop stop edge 222 spaced from, or "floating above," the catchment wheel outer surface 212.

The catchment prop body 220 may also include an elongated reset pin pocket 230 having a reset surface 232 and a positioning surface 234. The reset pin pocket 230 preferably extends longitudinally along an edge of the catchment prop body 220. The reset surface 232 is disposed at one end of the reset pin pocket 230 and the positioning surface 234 is disposed at the other end of the reset pin pocket 230. That is, the reset surface 232 is disposed at the end of the reset pin pocket 230 adjacent to the catchment wheel 202 and the positioning surface 234 is disposed at the other end of the reset pin pocket 230.

The catchment prop reset pin 206 is structured to be coupled to the rocker arm assembly 136 and extends generally perpendicular to the rocker arm assembly body 160. The catchment prop reset pin 206 is structured to operatively engage the reset pin pocket reset surface 232 and the reset pin pocket positioning surface 234.

The catchment mechanism 200 is assembled as follows. The catchment wheel 202 is fixed to the cam shaft 132. As such, any rotation of the cam shaft 132 also causes the catchment wheel 202 to rotate and, conversely, if the catchment wheel 202 is stopped from rotating, the motion of the cam shaft 132 is arrested as well. Preferably, the catchment wheel 202 is disposed adjacent to the cam 134. When the catchment wheel 202 is coupled to the cam shaft 132, the catchment wheel radially extending surface 210 has a path of travel about the cam shaft 132.

The catchment prop body 220 is pivotally coupled to the housing assembly 12 so that the catchment prop body 220 moves in a plane that is aligned with the catchment wheel 202. Preferably, the catchment assembly spring 205 is a torsion spring 207 disposed at the pivotal coupling of the catchment prop body 220 to the housing assembly 12. When the catchment prop body 220 is in the stop position, the catchment prop stop edge 222 is positioned closely adjacent, but preferably not contacting, the catchment wheel outer surface 212. When the catchment prop body 220 is in the stop position, the catchment prop stop edge 222 is disposed in the path of travel of the catchment wheel radially extending surface 210. The catchment prop reset pin 206 is coupled to the rocker arm assembly 136 and extends into the reset pin pocket 230.

In this configuration, the catchment mechanism 200 operates as follows. As shown in FIG. 6, at a starting point, it is assumed that the at least one spring 90 is fully charged and the latch assembly 180 is latched, that is, the latch prop body 190 is in the first position (FIG. 2A). Thus, the rocker arm assembly body 160 is also in the first position. As noted above, when the rocker arm body cam follower 164 is disposed on the stop radius 155, the force from the at least one spring 90 is transferred via the ram body 94 and the rocker arm assembly body 160 to the cam 134 and the cam 134 is encouraged to rotate so that rocker arm body cam follower 164 falls over the step 156. Further, the catchment prop body 220 is in the stop position and generally maintained in this position by the catchment assembly spring 205.

When the latch assembly 180 is released as set forth above, the cam 134 rotates in response to the force applied thereto by the rocker arm assembly 136. The rotation of the cam 134 causes the cam shaft 132, and therefore the catchment wheel 202, to rapidly rotate, as shown in FIG. 7. The catchment wheel 202 rotates until the catchment prop stop edge 222 engages the catchment wheel radially extending surface 210. When the catchment prop stop edge 222 engages the catchment wheel radially extending surface 210, the catchment wheel 202, and therefore the cam shaft 132 and the cam 134, can no longer rotate.

As further noted above, when the latch assembly 180 is released, the ram body 94 moves to the second position and, as the ram body 94 moves, the rocker arm assembly body 160 is moved to its second position. As shown in FIG. 8, when the rocker arm assembly body 160 is moved to its second position, the catchment prop reset pin 206 is moved to operatively engage the reset pin pocket reset surface 232. When the catchment prop reset pin 206 operatively engages the reset pin pocket reset surface 232, the catchment prop body 220 is moved into the reset position. It is noted that FIG. 8 shows the position of the catchment prop body 220 just before the rocker arm assembly body 160 reaches its second position. Thus, the catchment prop stop edge 222 is shown as still engaging the catchment wheel radially extending surface distal tip 214. It is understood that, when the rocker arm assembly body 160 reaches its second position, the catchment prop stop edge 222 is moved above the catchment wheel radially extending surface distal tip 214 and the catchment wheel outer surface 212.

Once the rocker arm assembly body 160 reaches its second position, the catchment prop stop edge 222 is position above the catchment wheel outer surface 212. In this configuration, the catchment wheel 202, and therefore the cam shaft 132 and the cam 134, are free to rotate. Thus, when the charging operator 130 is engaged, the cam shaft 132 and the cam 134, as well as the catchment wheel 202, rotate as set forth above. As further set forth above, the rocker arm assembly body 160 is moved to its first position. As the rocker arm assembly body 160 is moved to its first position, the catchment prop reset pin 206 contacts the reset pin pocket positioning surface 234 and returns the catchment prop body 220 to the stop position. Once the charging operation is complete, the catchment mechanism 200 is returned to the initial configuration set forth above and is ready for the next closing operation.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A catchment mechanism for an operating mechanism closing assembly in an electrical switching apparatus, said electrical switching apparatus having a housing assembly, an operating mechanism, and at least one pair of separable contacts structured to move between a first, open position, wherein said contacts are separated, and a second, closed position, wherein said contacts contact each other and are in electrical communication, said operating mechanism having a closing assembly structured to move said separable contacts from said first, open position to said second, closed position, said closing assembly having a cam fixed to a rotatable cam shaft, said cam shaft being rotatably coupled to said housing assembly and at least one spring, said cam structured to rotate in a charging direction whereby said at least one spring is charged, wherein, after the release of the charged at least one spring, said cam shaft is free to rotate, said catchment mechanism comprising:

a catchment wheel having a radially extending surface, said catchment wheel being fixed to said cam shaft;

a catchment prop having a body with a stop edge and a pivot point, said catchment prop being pivotally coupled to said housing assembly at said catchment prop pivot point, said catchment prop structured to move between a stop position, wherein said stop edge is positioned to engage said catchment wheel radially extending surface, and a reset position, wherein said stop edge is spaced from said catchment wheel outer surface; and wherein, after the release of the charged at least one spring, said cam shaft rotates until said catchment prop stop edge engages said catchment wheel radially extending surface.

2. The catchment mechanism of claim 1 wherein:

said catchment wheel outer surface has a variable radius; and said catchment wheel outer surface having a maximum radius at the distal tip of said radially extending surface.

3. The catchment mechanism of claim 1 wherein said catchment prop pivot point corresponds to said rocker arm pivot point.

4. A catchment mechanism for an operating mechanism closing assembly in an electrical switching apparatus, said electrical switching apparatus having a housing assembly, an operating mechanism, and at least one pair of separable contacts structured to move between a first, open position, wherein said contacts are separated, and a second, closed position, wherein said contacts contact each other and are in electrical communication, said operating mechanism having a closing assembly structured to move said movable contact structured from said first, open position to said second, closed position, said closing assembly having a cam fixed to a rotatable cam shaft, said cam shaft being rotatably coupled to said housing assembly, a rocker arm assembly pivotally coupled to said housing assembly at a pivot point and structured to move between a first position and a second position, a ram assembly structured to move between a first position and a second position, and at least one spring, said cam structured to operatively engage said rocker arm assembly so that rotation of said cam causes said rocker arm assembly to move from said second position to said first position, said rocker arm assembly structured to be selectively coupled to, and operatively engage, said ram assembly so that movement of said rocker arm assembly in a charging direction causes said ram assembly to move from said second position to said first position, said ram assembly structured to operatively engage said at least one spring when moved in a charging direction whereby said at least one spring is charged, wherein, when said at least one spring is charged, said rocker arm assembly operatively engages said cam and wherein, after the release of the charged at least one spring, said rocker arm assembly does not operatively engage said cam and said cam shaft is free to rotate, said catchment mechanism comprising:

a catchment wheel having a radially extending surface, said catchment wheel being fixed to said cam shaft;

a catchment prop having a body with a stop edge and a pivot point, said catchment prop being pivotally coupled to said housing assembly at said catchment prop pivot point, said catchment prop structured to move between a stop position, wherein said stop edge is positioned to engage said catchment wheel radially extending surface, and a reset position, wherein said stop edge is spaced from said catchment wheel outer surface;

a catchment prop reset pin coupled to said rocker arm assembly; and wherein, after the release of the charged at least one spring, said cam shaft rotates until said catchment prop stop edge engages said catchment wheel radially extending surface.

5. The catchment mechanism of claim 4 wherein:

said catchment wheel outer surface has a variable radius; and said catchment wheel outer surface having a maximum radius at the distal tip of said radially extending surface.

6. The catchment mechanism of claim 5 wherein said catchment prop body does not engage said catchment wheel outer surface other than at said radially extending surface.

7. The catchment mechanism of claim 4 wherein said catchment prop pivot point corresponds to said rocker arm pivot point.

8. The catchment mechanism of claim 4 wherein:

said catchment prop body is disposed adjacent to said rocker arm assembly;

said catchment prop body includes an elongated reset pin pocket having a reset surface and a positioning surface, said reset surface disposed at one end of said reset pin pocket and said positioning surface disposed at the other end of said reset pin pocket; and wherein said catchment prop reset pin is disposed within said reset pin pocket.

9. The catchment mechanism of claim 8 wherein:

said catchment prop reset pin is structured to operatively engage said reset pin pocket reset surface as said rocker arm assembly moves from said first position to said second position; and wherein, when said catchment prop reset pin operatively engages said reset pin pocket reset surface, said catchment prop reset pin is structured to cause said catchment prop body to move from said stop position to said reset position.

10. The catchment mechanism of claim 9 wherein:

said catchment prop reset pin is structured to operatively engage said reset pin pocket positioning surface as said rocker arm assembly moves from said second position to said first position; and wherein, when said catchment prop reset pin operatively engages said reset pin pocket positioning surface, said catchment prop reset pin is structured to cause said catchment prop body to move from said reset position to said stop position.

11. An electrical switching apparatus comprising:

a housing assembly defining an enclosed space;

a plurality of side plates, said side plates disposed within said housing assembly enclosed space, generally parallel to each other, said side plates having a plurality of aligned openings therein whereby one or more elongated members may be coupled, including rotatably coupled, perpendicular to and between adjacent side plates;

at least one pair of separable contacts structured to move between a first, open position, wherein said contacts are separated, and a second, closed position, wherein said contacts contact each other and are in electrical communication;

an operating mechanism disposed in said housing assembly, said operating mechanism having a closing assembly structured to move said movable contact structured from said first, open position to said second, closed position;

said closing assembly having a cam, a rocker arm assembly, a ram assembly, and at least one spring;

said cam fixed to a rotatable cam shaft, said cam shaft being rotatably coupled to said housing assembly;

said rocker arm assembly pivotally coupled to said housing assembly at a pivot point and structured to move between a first position and a second position;

said ram assembly structured to move between a first position and a second position;

said cam structured to operatively engage said rocker arm assembly so that rotation of said cam causes said rocker arm assembly to move from said second position to said first position;

said rocker arm assembly structured to be selectively coupled to, and operatively engage, said ram assembly so that movement of said rocker arm assembly in a charging direction causes said ram assembly to move from said second position to said first position;

said ram assembly structured to operatively engage said at least one spring when moved in a charging direction whereby said at least one spring is charged;

wherein, when said at least one spring is charged, said rocker arm assembly operatively engages said cam;

wherein, after the release of the charged at least one spring, said rocker arm assembly does not operatively engage said cam and said cam shaft is free to rotate;

a catchment mechanism having a catchment wheel and a catchment prop;

said catchment wheel having a radially extending surface, said catchment wheel being fixed to said cam shaft;

said catchment prop having a body with a stop edge and a pivot point, said catchment prop being pivotally coupled to said housing assembly at said catchment prop pivot point, said catchment prop structured to move between a stop position, wherein said stop edge is positioned to engage said catchment wheel radially extending surface, and a reset position, wherein said stop edge is spaced from said catchment wheel outer surface; and wherein, after the release of the charged at least one spring, said cam shaft rotates until said catchment prop stop edge engages said catchment wheel radially extending surface.

12. The electrical switching apparatus of claim 11 wherein:

said catchment wheel outer surface has a variable radius; and said catchment wheel outer surface having a maximum radius at the distal tip of said radially extending surface.

13. The electrical switching apparatus of claim 11 wherein said catchment prop pivot point corresponds to said rocker arm pivot point.

14. An electrical switching apparatus comprising:

a housing assembly defining an enclosed space;

a plurality of side plates, said side plates disposed within said housing assembly enclosed space, generally parallel to each other, said side plates having a plurality of aligned openings therein whereby one or more elongated members may be coupled, including rotatably coupled, perpendicular to and between adjacent side plates;

at least one pair of separable contacts structured to move between a first, open position, wherein said contacts are separated, and a second, closed position, wherein said contacts contact each other and are in electrical communication;

an operating mechanism disposed in said housing assembly, said operating mechanism having a closing assembly structured to move said movable contact structured from said first, open position to said second, closed position;

said closing assembly having a cam, a rocker arm assembly, a ram assembly, and at least one spring;

said cam fixed to a rotatable cam shaft, said cam shaft being rotatably coupled to said housing assembly;

said rocker arm assembly pivotally coupled to said housing assembly at a pivot point and structured to move between a first position and a second position;

said ram assembly structured to move between a first position and a second position;

said cam structured to operatively engage said rocker arm assembly so that rotation of said cam causes said rocker arm assembly to move from said second position to said first position;

said rocker arm assembly structured to be selectively coupled to, and operatively engage, said ram assembly so that movement of said rocker arm assembly in a charging direction causes said ram assembly to move from said second position to said first position;

said ram assembly structured to operatively engage said at least one spring when moved in a charging direction whereby said at least one spring is charged;

wherein, when said at least one spring is charged, said rocker arm assembly operatively engages said cam;

wherein, after the release of the charged at least one spring, said rocker arm assembly does not operatively engage said cam and said cam shaft is free to rotate;

a catchment mechanism having a catchment wheel, a catchment prop, and a catchment prop reset pin;

said catchment wheel having a radially extending surface, said catchment wheel being fixed to said cam shaft;

said catchment prop having a body with a stop edge and a pivot point, said catchment prop being pivotally coupled to said housing assembly at said catchment prop pivot point, said catchment prop structured to move between a stop position, wherein said stop edge is positioned to engage said catchment wheel radially extending surface, and a reset position, wherein said stop edge is spaced from said catchment wheel outer surface;

said catchment prop reset pin coupled to said rocker arm assembly; and wherein, after the release of the charged at least one spring, said cam shaft rotates until said catchment prop stop edge engages said catchment wheel radially extending surface.

15. The electrical switching apparatus of claim 14 wherein:

said catchment wheel outer surface has a variable radius; and said catchment wheel outer surface having a maximum radius at the distal tip of said radially extending surface.

16. The electrical switching apparatus of claim 15 wherein said catchment prop body does not engage said catchment wheel outer surface other than at said radially extending surface.

17. The electrical switching apparatus of claim 14 wherein said catchment prop pivot point corresponds to said rocker arm pivot point.

18. The electrical switching apparatus of claim 14 wherein:

said catchment prop body is disposed adjacent to said rocker arm assembly;

said catchment prop body includes an elongated reset pin pocket having a reset surface and a positioning surface, said reset surface disposed at one end of said reset pin pocket and said positioning surface disposed at the other end of said reset pin pocket; and wherein said catchment prop reset pin is disposed within said reset pin pocket.

19. The electrical switching apparatus of claim 18 wherein:

said catchment prop reset pin is structured to operatively engage said reset pin pocket reset surface as said rocker arm assembly moves from said first position to said second position; and wherein, when said catchment prop reset pin operatively engages said reset pin pocket reset surface, said catchment prop reset pin is structured to cause said catchment prop body to move from said stop position to said reset position.

20. The electrical switching apparatus of claim 19 wherein:

said catchment prop reset pin is structured to operatively engage said reset pin pocket positioning surface as said rocker arm assembly moves from said second position to said first position; and wherein, when said catchment prop reset pin operatively engages said reset pin pocket positioning surface, said catchment prop reset pin is structured to cause said catchment prop body to move from said reset position to said stop position.

* * * * *